US008092147B2

(12) United States Patent
Draeger et al.

(10) Patent No.: US 8,092,147 B2
(45) Date of Patent: Jan. 10, 2012

(54) TURBINE FOR POWER GENERATION IN A DRILL STRING

(75) Inventors: Uwe Draeger, Barsinghausen (DE); Helmut Winnacker, Burgdorf (DE)

(73) Assignee: Weatherford Energy Services GmbH, Edemissen (DE)

( * ) Notice: Subject to any disclaimer, the term of this patent is extended or adjusted under 35 U.S.C. 154(b) by 694 days.

(21) Appl. No.: 12/283,084

(22) Filed: Sep. 9, 2008

(65) Prior Publication Data

US 2009/0104021 A1 Apr. 23, 2009

(30) Foreign Application Priority Data

Oct. 17, 2007 (DE) ..... 10 2007 050 048

(51) Int. Cl.
*F01B 25/10* (2006.01)
*F01B 25/22* (2006.01)

(52) U.S. Cl. ..... 415/28; 415/49; 415/145; 415/202; 415/903; 415/904

(58) Field of Classification Search ..... None
See application file for complete search history.

(56) References Cited

U.S. PATENT DOCUMENTS

| | | | | |
|---|---|---|---|---|
| 2,879,032 A | | 3/1959 | Whittle et al. | |
| 4,396,071 A | * | 8/1983 | Stephens | 175/50 |
| 5,505,587 A | * | 4/1996 | Ghetzler | 415/49 |
| 5,839,508 A | | 11/1998 | Tubel et al. | |

FOREIGN PATENT DOCUMENTS

| | | |
|---|---|---|
| EP | 0 069 530 | 1/1983 |
| GB | 1066201 | 4/1967 |
| JP | 04-022766 | 1/1992 |

OTHER PUBLICATIONS

British Search Report dated Feb. 16, 2009.

* cited by examiner

*Primary Examiner* — Benjamin Sandvik
*Assistant Examiner* — Joseph Schoenholtz
(74) *Attorney, Agent, or Firm* — Collard & Roe, P.C.

(57) ABSTRACT

The invention is directed to a turbine (3) for generating power in a drill string (2), including a turbine rotor (10) drivable by a fluid and a bypass device having a first bypass channel bypassing the turbine rotor (10). For varying the volumetric flow through the bypass channel, provision is made for a valve (28) and a control device driven by the fluid and having a drive element (24) by means of which the valve (28) is movable anywhere between a first and a second position. The drive element (24) produces a flow resistance in the fluid flow path downstream from the turbine rotor (10) and downstream from the valve (28) and in the flow direction takes support upon a spring (26).

20 Claims, 3 Drawing Sheets

TURBINE FOR POWER GENERATION IN A DRILL STRING

CROSS REFERENCE TO RELATED APPLICATIONS

Applicants claim priority under 35 U.S.C. §119 of German Application No. 10 2007 050 048.5 filed on Oct. 17, 2007.

FIELD OF THE INVENTION

This invention relates to a turbine for generating power in a drill string, with a turbine rotor drivable by a fluid, and a bypass device having a first bypass channel bypassing the turbine rotor, a valve for varying the volumetric flow through the bypass channel, and a control device which is driven by the fluid and has a drive element by means of which the valve is movable anywhere between a first and a second position.

BACKGROUND OF THE INVENTION

In deep well drilling it is common practice to take measurements continuously while drilling by means of measurement systems installed in the drill string and to transmit the measurement results to the surface of the earth by means of telemetry devices. To generate the electric power required to operate the measurement systems and telemetry devices, use is generally made of a generator which is driven by a turbine arranged in the drill string. The turbine draws its drive energy from the flow of drilling fluid which is fed through the drill string to the drill bit. The problem encountered with this approach however is that the feed rate of the drilling fluid fed through the drill string is dependent on the drilling conditions such as pump capacity, well depth and physical properties of the drilling fluid, to name but a few, and can be subject to severe fluctuations on a scale of 1 to 4. Such fluctuations are unsuitable for the drive of the turbine and the generator connected thereto and would lead to hardly controllable fluctuations of rotational frequency and performance. It is necessary therefore to limit the feed rate of drilling fluid acting on the turbine rotor and to supply to the turbine, independently of the feed rate of the mud pump, only that feed rate required to achieve the desired drive performance.

From EP 0 069 530 A2 is known a bypass device for a turbine which is arranged in a drill string and has a valve which is arranged upstream from the turbine in the drill string in order to control the flow of fluid directed past the turbine. The valve is actuated by a piston arrangement which is acted upon in one direction by the pressure on the output side of the turbine and a compression spring, and in the opposite direction by the pressure on the input side of the turbine. The position of the valve varies in response to the pressure differential between input and output, thereby regulating the quantity of drilling fluid which gets to the turbine input and the quantity which flows past the turbine. By this means the output performance of the turbine should be maintained essentially constant in spite of changing operating conditions.

The known bypass device has the disadvantage that the pressure differential between the input and output of the turbine is dependent on the volumetric flow fed to the valve and the turbine on the input side and increases in the same proportion as the volumetric flow. Hence the device operates in the manner of a volumetric divider in which an increasing volumetric flow at the input produces not only an increase in the bypass flow but also an increase in the flow passing through the turbine. Severe fluctuations of the input flow thus lead also to severe fluctuations of the turbine flow and hence also of the turbine output performance, particularly since said performance increases as a rule more than proportional with the turbine current. The known device is therefore unsuitable for decoupling the turbine performance sufficiently from the fluctuations of the drilling fluid supply.

In addition there is known from JP 04022766 A a speed controlling device for a turbine generator arranged in a drill string, wherein a valve is arranged at the turbine input and held in an open position by spring force. A bypass channel bypassing the turbine is provided parallel to the input of the valve. In this arrangement, the valve is increasingly closed as the feed rate of the supplied drilling fluid increases so that the bypass rate increases while the volumetric flow which reaches the turbine is kept essentially constant. This device has the disadvantage that a relatively large bypass cross section is always open so that in the presence of small feed rates the flow flowing to the turbine is too small. In addition there is the risk, particularly with the valve closed to greater degrees, of the valve passage becoming clogged with dirt particles entrained in the drilling fluid so that the drive performance of the turbine drops too severely or even that the turbine stops and the power supply collapses as the result.

SUMMARY OF THE INVENTION

It is an object of the present invention to provide a turbine for power generation in a drill string of the type initially referred to, whose rotational frequency and drive performance are largely independent of the feed rate of the drilling fluid fed through the drill string to the drill bit. In addition it is an object of the invention to provide a turbine of the type initially referred to whose performance characteristic exhibits a shallow curve which does not exceed a predetermined maximum value. The turbine and the bypass device should be insensitive to contamination and be permeable to solid particles up to a defined particulate size. Finally, the bypass device should distinguish itself by a fast responding and low-hysteresis control action.

According to the invention a turbine for generating power in a drill string comprises a turbine rotor drivable by a fluid, and a bypass device having a first bypass channel bypassing the turbine rotor, a valve for varying the volumetric flow through the bypass channel, and a control device which is driven by the fluid and has a drive element by means of which the valve is movable anywhere between a first and a second position, wherein said drive element in the flow direction takes support upon a spring and produces a flow resistance in the flow path downstream from the turbine rotor and downstream from the valve. In an embodiment of the invention, the path of the drive element of the control device is dependent on the dynamic pressure which the flow resistance of the drive element generates in the fluid. The magnitude of the dynamic pressure is governed by the velocity of fluid flow, which for given flow cross-sections conducting the fluid flow is directly proportional to the feed rate of the fluid flow. From this it follows that the movement of the drive element and hence of the valve is dependent only on the feed rate of the fluid fed through the drill string. Hence the control device and valve can be designed such that with an increasing feed rate essentially only the bypass flow increases and the volumetric flow available to the turbine remains essentially constant after the desired magnitude is reached. The relationship between input pressure and output pressure at the turbine has not effect on the valve position. Preferably, control of the valve is designed such that the valve remains closed until the feed rate reaches the order of magnitude required to achieve the desired maximum output performance of the turbine. If the feed rate continues to increase beyond this point, then the higher dynamic pressure on the drive element causes the valve to open, which directs the part of the feed rate exceeding the ideal rate for the turbine through the bypass channel past the turbine.

According to another embodiment of the invention provision is made for at least part of the bypass flow to be directed into the output channel of the turbine. Opening the bypass thus effects an increase of pressure in the output channel of the turbine, such that the pressure differential between turbine input and turbine output is reduced. In this way an increase of the turbine performance after opening the bypass is additionally counteracted, thus resulting in combination with the opening of the bypass in a favorable turbine performance characteristic over a wide feed rate range.

According to another embodiment of the invention, the bypass device may include a second bypass channel bypassing the turbine rotor and the valve, wherein the volumetric flow through the second bypass channel is variable by means of an adjustable throttling device which has a throttling element which can be moved by the drive element of the control device. The provision of the second bypass channel enables the use of a turbine for smaller drill pipes in drill pipes with a larger diameter and an accordingly higher feed rate. As the result, the turbine designed for use in smaller drill pipes can also be used in larger drill pipes without the volumetric flow acting on the turbine exceeding the desired permissible level.

BRIEF DESCRIPTION OF THE DRAWINGS

The present invention will be explained in the following in more detail with reference to embodiments illustrated in the accompanying drawing. In the drawing.

DETAILED DESCRIPTION OF THE DRAWINGS

Figure 1:
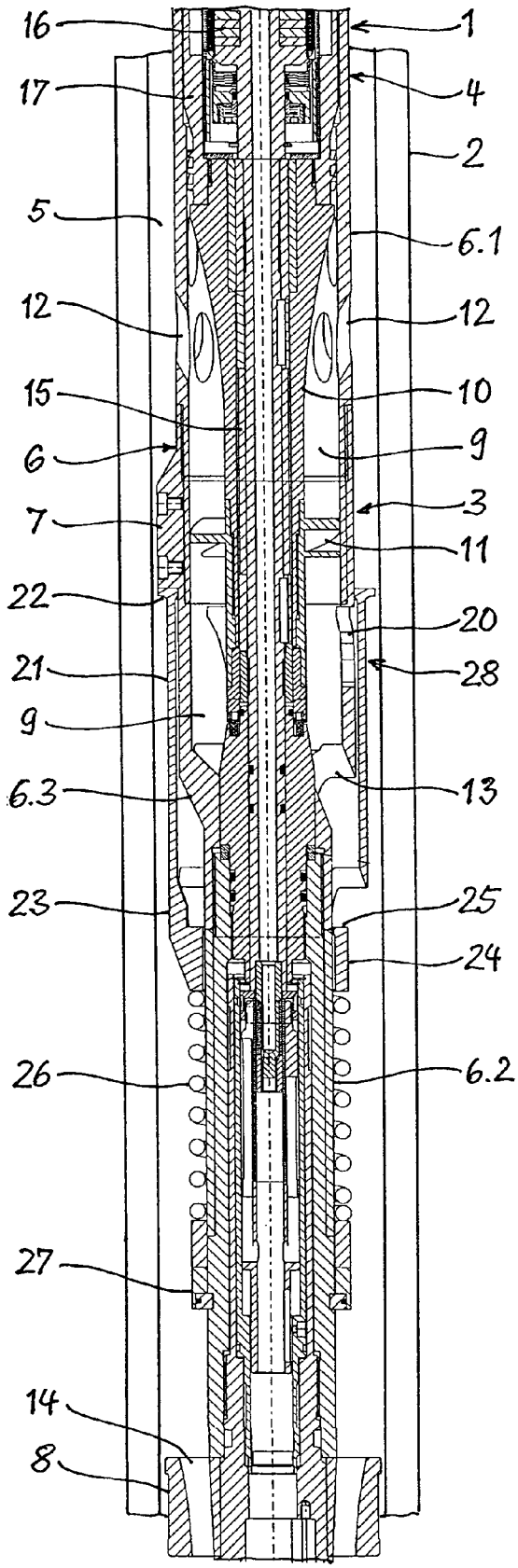
FIG. 1 is a longitudinal sectional view of a turbine illustrating a first embodiment of the invention.

Presented in the drawing in longitudinal section are sections of a sensor device 1 and a drill string 2 receiving the sensor device 1. Such sensor devices are used in deep well drilling and serve to log measurement data which during drilling operations throw light on the drilling direction and the drilling conditions in the borehole. By means of suitable telemetry devices the collected data is transmitted to the earth's surface for evaluation. Operation of the measurement instruments and the telemetry devices requires electric power which is generated in the illustrated sections of the sensor device 1 by means of a turbine 3 and a generator 4 driven thereby.

The sensor device 1 has a cylindrical housing 6 with a first housing section 6.1 of larger diameter and a second housing section 6.2 of smaller diameter, said housing sections being separated from each other by a housing shoulder 6.3. The housing section 6.1 has on its outer side three short guide ribs 7 which are arranged at a uniform circumferential distance from each other and serve to guide the housing 6 in the drill string 2. The housing section 6.2 carries for the same purpose a guide ring 8 with three sector-shaped openings 14 for passage of the drilling fluid, the openings being separated from each other by radial bars.

The housing section 6.1 accommodates a turbine compartment 9 in which a turbine rotor 10 with blades 11 is arranged. The turbine compartment 9 is connected upstream from the guide ribs 7 by radial inlet openings 12 and downstream from the guide ribs 7 by axial outlet openings 13 to the annular chamber 5 between the housing 6 and the drill string 2. The outlet openings 13 are provided in the housing shoulder 6.3. The blades 11 of the turbine rotor 10 are located in an annularly closed region of the turbine compartment 9, which lies within the guide ribs 7.

Extending through the housing 6 in longitudinal direction is a central axle 15 which has its ends connected securely and in pressure-tight manner to the housing 6 and carries the supporting structure of the turbine rotor 10 and the stator 16 of the generator 4. The axle 15 has a longitudinal through-bore, thus enabling an electric bus connection from one end of the housing 6 to the other. As the result, the housing 6 can be arranged at any point of a sensor device made up of several sections. The generator rotor 17 has its one end securely fastened to the turbine rotor 10 and is supported and rotatably driven by the turbine rotor 10.

Between the guide ribs 7 and the housing shoulder 6.3 the housing section 6.1 has several, preferably three valve openings 20 which are evenly distributed over the circumference. Associated with the valve openings 20 is a sleeve-shaped closure element 21 which surrounds the housing section 6.1 and is guided thereon in a sliding relationship. The closure element 21 has on its end close to the guide ribs 7 an annular flange 22 which closes largely but not completely the annular chamber 5 between the drill string 2 and the housing section 6.1. The opposing end of the closure element 21 is located downstream at a distance from the housing shoulder 6.3 where it is connected via three axially extending bars 23 spaced at a uniform circumferential distance from each other to a sleeve-shaped drive element 24 which surrounds the housing section 6.2 and is guided thereon in a sliding relationship. The drive element 24 is arranged at an axial distance from the closure element 21 and has on its side close to the closure element 21 a radially extending end face 25 onto which the closure element directs the volumetric flow escaping from it. On the side facing away from the closure element 21 the drive element 24 rests against a compression spring 26. The opposing end of the compression spring 26 bears against a stop ring 27 which is fastened to the housing section 6.2. The compression spring 26 is dimensioned such that in the normal position illustrated in the drawing it applies a defined spring force to the closure element 21, thereby urging the flange 22 of the closure element 21 against the frontal ends of the guide ribs 7. The magnitude of said spring force decides at which feed rate through the drill string the closure element begins to move and lifts itself clear of the guide ribs.

The valve openings 20 and the closure element 21 combine to form a valve 28 which in the open position connects the annular chamber 5 lying upstream from the valve 28 to the section of the turbine compartment 9 lying on the outlet side of the turbine rotor 10. The annular chamber 5 and the valve 28 thus form a bypass device through which part of the volumetric flow fed to the inlet side of the turbine 3 can be directed past the turbine rotor 10 to the outlet side of the turbine 3, with the magnitude of the bypass flow being variable with the aid of the valve 28.

The variation characteristic of the bypass flow is determined by the cross-sectional shape of the valve openings 20 and the actuating travel of the closure element 21. The actuating travel is dependent in turn on the force of the compression spring 26, the spring characteristic and the kinetic energy of the flow which is caused by the flow resistance of the drive element 24 and, in addition, to a certain degree, by the flow resistance of the closure element 21 in the fluid fed through the drill string. In the embodiment herein described, the valve openings 20 have a cross-section which extends in the axial direction, which has a maximum width in the circumferential direction at the end of the valve openings 20 adjacent to the guide ribs, and decreases continuously with increasing distance from said end. A characteristic of the cross-sectional variation based on an e function has proven to be advantageous. However, the suitable characteristic also depends on other design parameters, which means that other characteristics of the cross-sectional variation can also be used. If for example a progressive compression spring is used, then the valve openings 20 can also have an essentially constant width over the entire length.

Provided between the housing sections 6.1 and 6.2 and the cooperating sliding surfaces of the closure element 21 and the drive element 24 are comparatively large annular gaps for enabling the closure element 21 and the drive element 24 to be easily displaced out of the housing sections 6.1, 6.2 and respond directly to force variations. In addition, the movability of the closure element 21 guarantees a reliable control action even in extreme operating conditions such as temperatures of over 200° C. and pressures of over 2,000 bar.

In the drawing, valve 28 is shown in the closed position. In this position the entire supplied flow, which is fed from a mud pump through the drill string 2 in the direction of the drill bit, is directed through the turbine compartment 9 and the turbine rotor 10, with the exception of gap losses at the inner and outer circumference of the closure element 21. When the feed rate exceeds a certain magnitude, the flow-induced forces acting on the closure element 21 and the drive element 24 overcome the biasing force of the compression spring 26 and displace the closure element 21 under compression of the compression spring 26 in the flow direction to the point where the initial region of the valve openings 20 adjacent to the guide ribs 7 is opened. As the result, part of the feed rate is allowed to flow past the turbine rotor 10 to the outlet side of the turbine so that the volumetric flow driving the turbine rotor 10 is increased insignificantly or not at all and the turbine rotor 10 essentially maintains its rotational frequency or output. The opening of the valve 28 has no notable influence on the degree of displacement of the closure element 21 and hence on the resulting opening position because the flow forces acting on the drive element 24 and the closure element 21 are generated even with an open valve by the complete feed rate passing through the drill string. The actuating travel of the valve 28 is thus determined nearly exclusively by the feed rate of the drilling fluid and the design of the compression spring 26. By contrast, the bypass rate bypassing the turbine is governed primarily by the cross-sections of orifice of the valve openings 20 exposed by the closure element 21 and by the pressure differentials resulting at the turbine rotor on the one hand, and by the valve openings 20 on the other hand, on account of the rate-dependent flow velocity. Through the design of the valve openings 20 it is possible to vary the increase of the cross-section of orifice in relation to the actuating travel of the closure element 21 and hence to adapt it in easy manner to the desired control action. It is thus possible on the one hand to ensure that the desired maximum rotational frequency and maximum output remain constant after being reached even with an increasing feed rate. Similarly it is possible, with an increasing feed rate, to effect a slight increase or decrease in the rotational frequency and performance of the turbine. At all events it is possible with the described design of the bypass device to ensure that the turbine rotational frequency and the turbine performance do not exceed predetermined maximum values and that the generator and the electrical components connected thereto do not suffer any damage.

Figure 2:
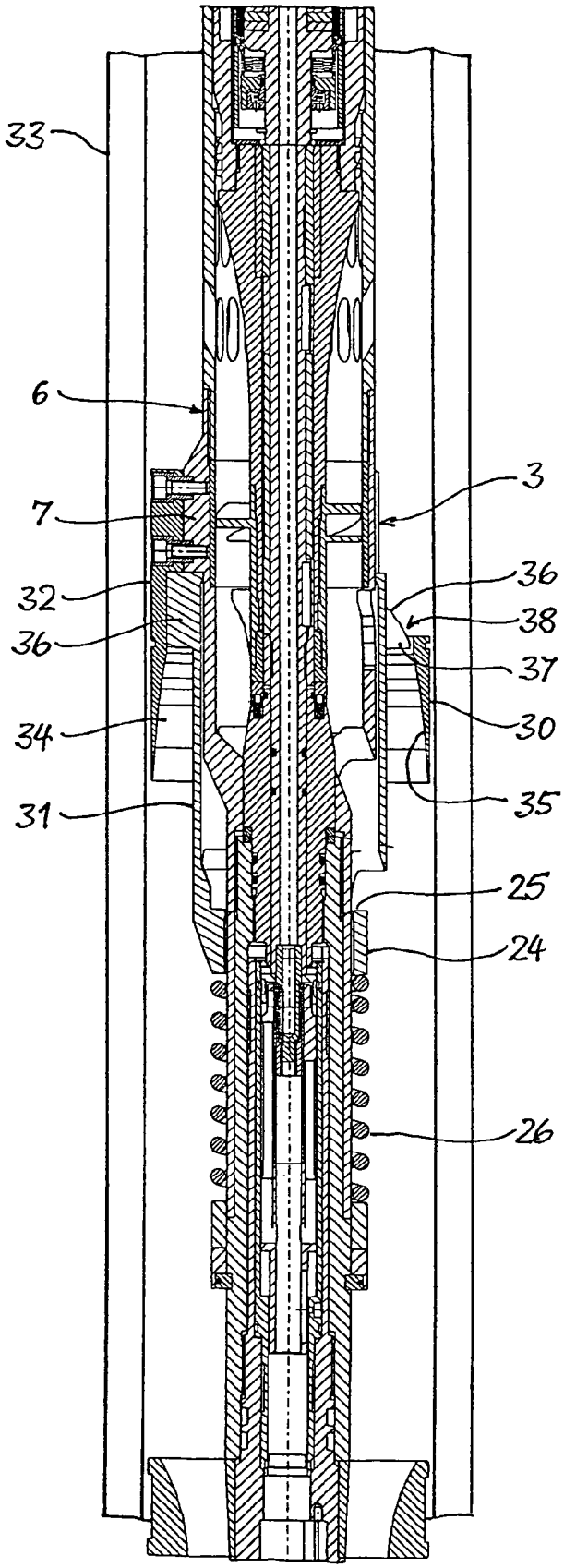
FIG. 2 is a longitudinal sectional view illustrating a second embodiment based on the turbine of FIG. 1.

FIG. 2 shows a further aspect of the embodiment of FIG. 1, which enables without any elaborate changes the use of the same turbine in a drill string with a larger inner diameter. This further aspect differs from the embodiment of FIG. 1 in that it has an additional bypass sleeve 30 and a modified closure element 31 which is likewise axially displaceably guided on the housing 6. The bypass sleeve 30 surrounds with radial clearance the closure element 31 and has its afflux end screw-fitted by means of axially protruding bars 32 to the guide ribs 7 of the housing 6 of the turbine 3. The outer diameter of the bypass sleeve 30 is adapted to the inner diameter of the associated drill string 33 for centrally locating and guiding the housing 6 in the drill string 33. The afflux end of the bypass sleeve 30 is arranged at an axial distance from the guide ribs 7 and the end of the closure element 31 abutting the guide ribs 7. Between the bypass sleeve 30 and the closure element 31 provision is made for a free annular chamber 34 which forms a second bypass channel. The bypass sleeve 30 has an inner wall 35 whose inner diameter is smallest at the afflux end and increases toward the other end, such that the flow cross-section of the annular chamber 34 grows larger in the flow direction. The variation of the flow cross-section is degressive, but it can also be linear or progressive depending on the desired control characteristic.

Figure 3:
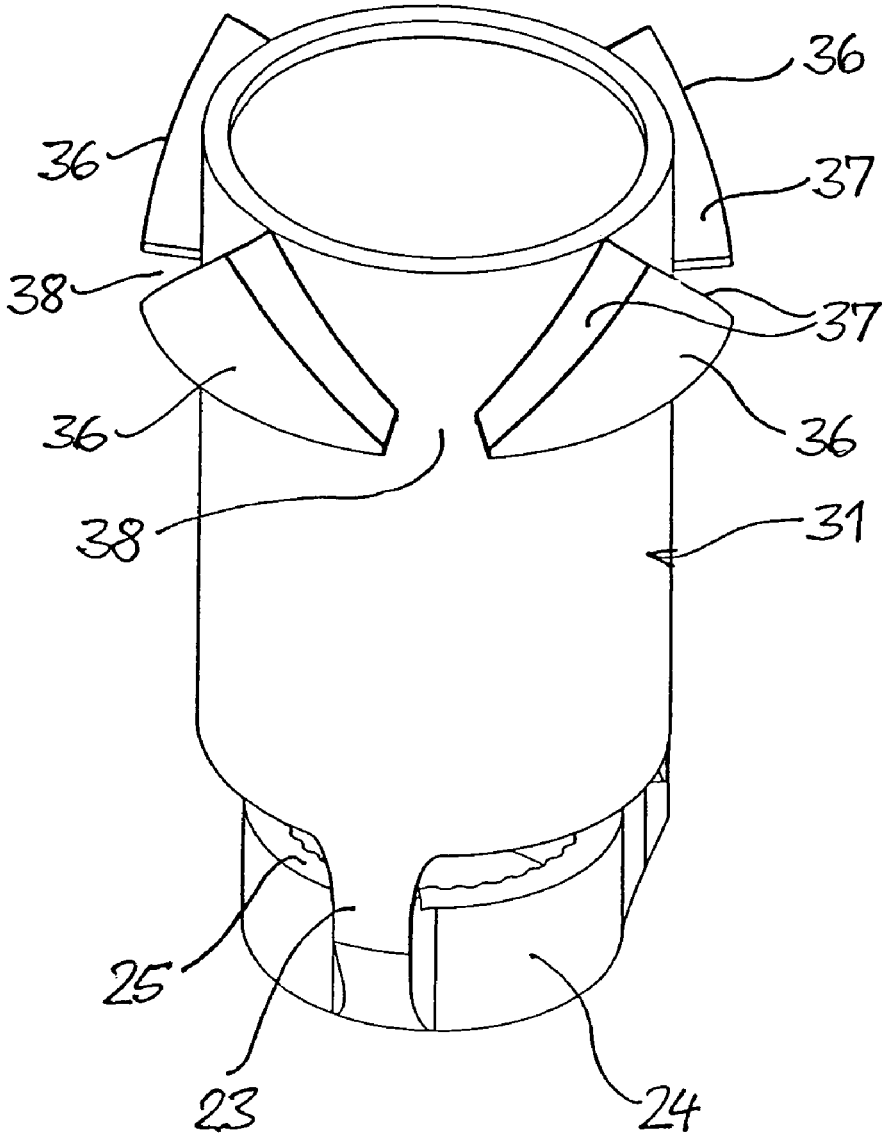
FIG. 3 is a perspective view of the closure element of the turbine of FIG. 2.

As becomes apparent in particular from FIG. 3, arranged on the outer circumferential surface of the closure element 31 are several throttling elements 36 which constrict the flow cross-section between the bypass sleeve 30 and the closure element 31. The throttling elements 36 have the shape of a pointed arrow whose tip is directed against the flow. The tip angle of the throttling elements 36 is preferably 90°. The lateral boundary surfaces 37 thus extend at an angle of 45° to the longitudinal axis in axial direction and in circumferential direction. The radial thickness of the throttling elements 36 is constant. The throttling elements 36 are arranged in spaced relationship in the circumferential direction such that channel-like passageways 38 for the passage of the fluid are formed between them. Owing to the arrow shape of the throttling elements 36, solid particles carried in the drilling fluid are directed into the passageways 38 so that they are unable to settle and accumulate into a cake which clogs the passageways 38. Larger particles are unable to remain caught on the throttling elements 36 and in the passageways 38. In radially outward direction, the throttling elements 36 are bounded by cylindrical surface sections which lie on a shared coaxial cylinder surface whose diameter is smaller than the smallest inner diameter of the inner wall 35 of the bypass sleeve 30 by a clearance which ensures the axial movability of the closure element 31 relative to the bypass sleeve 30.

In the embodiment of FIG. 2, the passageways 38 form in the normal position of the closure element 31 illustrated in the drawing a permanently open bypass through which part of the supplied feed rate is directed past the turbine 3. The size of the passageways 38 is designed in this case such that the turbine 3 receives a big enough fraction of the feed rate to obtain the desired turbine performance even in the case of the smallest feed rate customary with drill strings of this diameter. If the feed rate increases, then the joint flow resistance of the throttling elements 36 and the drive element 24 produces a force which overcomes the force of the compression spring 26 so that the closure element 31 is displaced in the flow direction and the valve openings 20 are opened. In accordance with the greater flow resistance, the minimum force of the compression spring 26 can be greater than in the embodiment of FIG. 1. Through the additional opening of the first bypass, the bypass rate as a whole is increased and the increase in the feed rate is compensated for entirely or in part, depending on the configuration, such that the turbine 3 continues to receive only that fraction of the feed rate intended for it. With the continuing increase in the feed rate and the corresponding increase in the flow forces, the closure element 31 is displaced further and further in the direction of the compression spring 26, whereby the throttling elements 36 enter more and more into the region of the larger inner diameter of the bypass sleeve 30. This effects an increase in the bypass cross-section in the region of the bypass sleeve, which cross-sectional increase is coordinated with the corresponding cross-sectional variation of the valve openings 50, such that the desired division of the feed rate between the turbine 3 and the bypass is obtained.

The described turbine with bypass device adjustable in response to the feed rate is characterized by its straightforward construction and reliable mode of operation. No narrow bearing gaps and no seals are provided on the moving parts, hence the control works without notable hysteresis. The size and design of the flow paths can be configured so that solid particles carried in the fluid do not cause any disturbances. In the embodiment of FIG. 1, the bypass channel can be completely closed, thereby enabling full use to be made of small feed rates to generate power. In addition, the embodiment of FIG. 2 shows that through simple modification the turbine can also be adapted to drill strings with larger diameter.

What is claimed is:

1. A turbine for generating power in a drill string, with a turbine rotor drivable by a fluid, a bypass device having a first bypass channel bypassing the turbine rotor, a valve for varying the volumetric flow through the bypass channel, and a control device which is driven by the fluid and has a drive element via which the valve is movable anywhere between a first and a second position, wherein said drive element produces a flow resistance in the fluid flow path downstream from the turbine rotor and downstream from the valve and in the flow direction takes support upon a spring, the turbine further comprising a cylindrical housing having a first housing section of larger diameter and a second housing section of smaller diameter, said housing sections being separated from each other by a housing shoulder, wherein the housing section of larger diameter has on its outer side guide ribs which are arranged at a circumferential distance from each other and form a guide for the housing in the drill string.

2. The turbine according to claim 1, wherein the first bypass channel opens into a turbine compartment on the outlet side of the turbine rotor.

3. The turbine according to claim 1, wherein the turbine rotor is arranged in a turbine compartment of the housing section of larger diameter, said turbine compartment being connected upstream from the guide ribs by radial inlet openings and downstream from the guide ribs by outlet openings to an annular chamber formed between the housing and the drill string.

4. The turbine according to claim 3, wherein the outlet openings are provided in the housing shoulder.

5. The turbine according to claim 1, wherein the turbine rotor is arranged in a turbine compartment of a housing and the valve has several valve openings which are evenly distributed over the circumference of a housing section, and wherein a sleeve-shaped closure element which is associated with said valve openings, surrounds the housing section and is guided thereon in a sliding relationship.

6. The turbine according to claim 5, wherein in the open position the valve openings connect an annular chamber formed between the housing and the drill string to a section of the turbine compartment lying on the outlet side of the turbine rotor.

7. The turbine according to claim 1, wherein the spring is a compression spring which is seated on the housing section of smaller diameter of the housing between the drive element and a stop formed fast with the housing.

8. A turbine for generating power in a drill string, with a turbine rotor drivable by a fluid, a bypass device having a first bypass channel bypassing the turbine rotor, a valve for varying the volumetric flow through the bypass channel, and a control device which is driven by the fluid and has a drive element via which the valve is movable anywhere between a first and a second position, wherein said drive element produces a flow resistance in the fluid flow path downstream from the turbine rotor and downstream from the valve and in the flow direction takes support upon a spring, wherein the bypass device includes a second bypass channel bypassing the turbine rotor and the valve, wherein the volumetric flow through the second bypass channel is variable by means of an adjustable throttling device.

9. The turbine according to claim 8, wherein the adjustable throttling device includes a throttling element which is movable by the drive element of the control device.

10. The turbine according to claim 9, wherein at least one throttling element has the shape of a pointed arrow whose tip is directed against the flow.

11. A turbine for generating power in a drill string, with a turbine rotor drivable by a fluid, a bypass device having a first bypass channel bypassing the turbine rotor, a valve for varying the volumetric flow through the bypass channel, and a control device which is driven by the fluid and has a drive element via which the valve is movable anywhere between a first and a second position, wherein said drive element produces a flow resistance in the fluid flow path downstream from the turbine rotor and downstream from the valve and in the flow direction takes support upon a spring, wherein the turbine rotor is arranged in a turbine compartment of a housing and the valve has several valve openings which are evenly distributed over the circumference of a housing section, and wherein a sleeve-shaped closure element which is associated with said valve openings, surrounds the housing section and is guided thereon in a sliding relationship, and wherein a bypass sleeve surrounding with radial clearance the closure element is fastened to the housing, and between the bypass sleeve and the closure element provision is made for a free annular chamber which forms a second bypass channel.

12. The turbine according to claim 11, wherein the bypass sleeve has an inner wall whose inner diameter is smallest at the afflux end and increases toward the other end, such that the flow cross-section of the annular chamber grows larger in the flow direction.

13. The turbine according to claim 11, wherein on the outer circumferential surface of the closure element provision is made for several throttling elements which constrict the flow cross-section between the bypass sleeve and the closure element wherein the volumetric flow through the second bypass channel is variable by axial movement of the bypass sleeve.

14. The turbine according to claim 13, wherein at least one throttling element has the shape of a pointed arrow whose tip is directed against the flow.

15. The turbine according to claim 13, wherein the throttling elements are arranged in spaced relationship in the circumferential direction and form between them channel-like passageways for the passage of the fluid.

16. A turbine for generating power in a drill string, with a turbine rotor drivable by a fluid, a bypass device having a first bypass channel bypassing the turbine rotor, a valve for varying the volumetric flow through the bypass channel, and a control device which is driven by the fluid and has a drive element via which the valve is movable anywhere between a first and a second position, wherein said drive element produces a flow resistance in the fluid flow path downstream from the turbine rotor and downstream from the valve and in the flow direction takes support upon a spring, the turbine further comprising a cylindrical housing having a first housing section of larger diameter and a second housing section of smaller diameter, said housing sections being separated from each other by a housing shoulder, wherein the housing section carries a guide ring with sector-shaped openings for passage of the fluid, said openings being separated from each other by radial bars.

17. A turbine for generating power in a drill string, with a turbine rotor drivable by a fluid, a bypass device having a first bypass channel bypassing the turbine rotor, a valve for varying the volumetric flow through the bypass channel, and a control device which is driven by the fluid and has a drive element via which the valve is movable anywhere between a first and a second position, wherein said drive element produces a flow resistance in the fluid flow path downstream from the turbine rotor and downstream from the valve and in the flow direction takes support upon a spring, wherein the turbine rotor is arranged in a turbine compartment of a housing and the valve has several valve openings which are evenly distributed over the circumference of a housing section, and wherein a sleeve-shaped closure element which is associated with said valve openings, surrounds the housing section and is guided thereon in a sliding relationship, and wherein the valve openings have a cross-section which extends in the axial direction and has a maximum width in the circumferential direction at the forward end of the valve openings as seen looking in the direction of flow, and decreases continuously with increasing distance from said end.

18. A turbine for generating power in a drill string, with a turbine rotor drivable by a fluid, a bypass device having a first bypass channel bypassing the turbine rotor, a valve for varying the volumetric flow through the bypass channel, and a control device which is driven by the fluid and has a drive element via which the valve is movable anywhere between a first and a second position, wherein said drive element produces a flow resistance in the fluid flow path downstream from the turbine rotor and downstream from the valve and in the flow direction takes support upon a spring, wherein the turbine rotor is arranged in a turbine compartment of a housing and the valve has several valve openings which are evenly distributed over the circumference of a housing section, and wherein a sleeve-shaped closure element which is associated with said valve openings, surrounds the housing section and is guided thereon in a sliding relationship, and wherein the closure element is connected via axially extending bars spaced at a uniform circumferential distance from each other to a sleeve-shaped drive element which is guided on a housing section of smaller diameter in a sliding relationship.

19. A turbine for generating power in a drill string, with a turbine rotor drivable by a fluid, a bypass device having a first bypass channel bypassing the turbine rotor, a valve for varying the volumetric flow through the bypass channel, and a control device which is driven by the fluid and has a drive element via which the valve is movable anywhere between a first and a second position, wherein said drive element produces a flow resistance in the fluid flow path downstream from the turbine rotor and downstream from the valve and in the flow direction takes support upon a spring, wherein the turbine rotor is arranged in a turbine compartment of a housing and the valve has several valve openings which are evenly distributed over the circumference of a housing section, and wherein a sleeve-shaped closure element which is associated with said valve openings, surrounds the housing section and is guided thereon in a sliding relationship, and wherein the drive element has on its side close to the closure element a radially extending end face to which the volumetric flow escaping from the closure element is applied.

20. A turbine for generating power in a drill string, with a turbine rotor drivable by a fluid, a bypass device having a first bypass channel bypassing the turbine rotor, a valve for varying the volumetric flow through the bypass channel, and a control device which is driven by the fluid and has a drive element via which the valve is movable anywhere between an open position and a closed position, wherein said drive element produces a flow resistance in the fluid flow path downstream from the turbine rotor and downstream from the valve and in the flow direction takes support upon a spring, wherein the turbine rotor is arranged in a turbine compartment of a housing and the valve has several valve openings which are evenly distributed over the circumference of a housing section, wherein a sleeve-shaped closure element which is associated with said valve openings, surrounds the housing section and is guided thereon in a sliding relationship, wherein in the open position the valve openings connect an annular chamber formed between the housing and the drill string to a section of the turbine compartment lying on the outlet side of the turbine rotor, and wherein in the closed position the sleeve-shaped closure element separates the annular chamber from the section of the turbine compartment lying on the outlet side of the turbine rotor.

* * * * *